US005320921A

United States Patent [19]

Oshiba et al.

[11] Patent Number: 5,320,921

[45] Date of Patent: Jun. 14, 1994

[54] ELECTROPHOTOGRAPHIC PHOTORECEPTOR

[75] Inventors: Takeo Oshiba; Yoshio Takizawa, both of Hachioji, Japan

[73] Assignee: Konica Corporation, Tokyo, Japan

[21] Appl. No.: 940,319

[22] Filed: Sep. 3, 1992

[30] Foreign Application Priority Data

Sep. 24, 1991 [JP] Japan ..... 3-272055

[51] Int. Cl.[5] ..... G03G 5/047; G03G 5/09; G03G 5/06

[52] U.S. Cl. ..... 430/58; 430/59; 430/78; 430/83

[58] Field of Search ..... 430/57, 58, 78, 83, 430/135, 59

[56] References Cited

U.S. PATENT DOCUMENTS 4,156,757 5/1979 Graser ..... 430/56 X
4,882,254 11/1989 Loutfy et al. ..... 430/59

FOREIGN PATENT DOCUMENTS 63-223753 9/1988 Japan ..... 430/58

*Primary Examiner*—Roland Martin
*Attorney, Agent, or Firm*—Finnegan, Henderson, Farabow, Garrett & Dunner

[57] ABSTRACT

An electrophotographic photoreceptor is disclosed. The photoreceptor comprises a conductive layer and provided thereon, a photoreceptor layer comprising a carrier generation layer containing 100 parts by weight of a polycyclic quinone compound and 0.01 to 100 parts by weight of at least one of compounds represented by the following Formulas (I) and (II):

Formula (I)

Formula (II)

11 Claims, 1 Drawing Sheet

ELECTROPHOTOGRAPHIC PHOTORECEPTOR

FIELD OF THE INVENTION

The present invention relates to an electrophotographic photoreceptor, particularly to an electrophotographic photoreceptor of high sensitivity, high durability and high image quality.

BACKGROUND OF THE INVENTION

As an electrophotographic photoreceptor, there has recently come to be known an organic photoreceptor having a good processability, an advantage in manufacturing cost, and a large degree of freedom in function designing. However, an organic photoreceptor developed in the early stage was not satisfactory in sensitivity and durability; therefore, there was developed an electrophotographic photoreceptor of function-separating type in which the carrier generation function and carrier transfer function are separately provided by different substances. Such an electrophotographic photoreceptor has an advantage that materials having appropriate characteristics can be selected from a wide range of compounds. This makes it possible to develop an organic photoreceptor of high sensitivity and high durability.

As carrier generation materials and carrier transfer materials, a variety of organic compounds are proposed; particularly, carrier generation materials have an important function to control fundamental characteristics of a photoreceptor. And as such carrier generation materials, there have so far been known polycyclic quinone compounds, perylene compounds, phthalocyanine compounds and azo compounds.

Electrophotographic photoreceptors using perylene compounds as a carrier generation material are disclosed, for example, in Japanese Pat. Exam. Pub. No. 8423/1986, Japanese Pat. O.P.I. Pub. Nos. 59686/1984, 180956/1988 and 291061/1988. But the perylene compounds used in those techniques are insufficient in color sensitivity, especially in red color reproduction, when used as a photoreceptor for plain paper copiers, because of their spectral sensitivities limited to 400 to 750 nm. Though there have also been proposed electrophotographic photoreceptors using a polycyclic quinone compound jointly with an azo compound or a phthalocyanine compound as a carrier generation material, these are not necessarily stable in repeatabilities of sensitivity, electrification potential and residual potential. Therefore, when these are used as positive electrification photoreceptors, the electrification potential is noticeably lowered by repeated use, and when images are formed with such a copier using the photoreceptors, white spots due to poor dispersion of carrier generation material are liable to occur.

The present invention is accomplished to solve the above problems. Accordingly, the object of the invention is to provide an electrophotographic photoreceptor excellent in spectral sensitivity, high in sensitivity and durability, free from lowering of electrification potential by repeated use, and thereby capable of preventing image defects.

SUMMARY OF THE INVENTION

The object of the invention is achieved by an electrophotographic photoreceptor having at least a photoreceptive layer on a conductive support, wherein said photoreceptive layer contains a perylene compound represented by the following Formula (I) and/or Formula (II) and a polycyclic quinone compound.

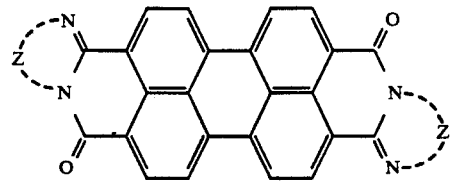

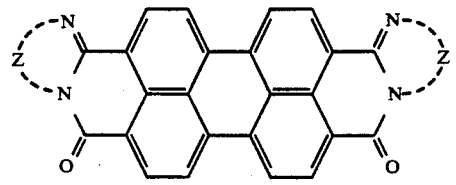

In the formulas, Z represents a group of atoms necessary to form a substituted or unsubstituted aromatic ring.

In the invention, it is preferable that the above polycyclic quinone compound has the structure represented by the following Formula (III), Formula (IV) or Formula (V).

Formula (III)

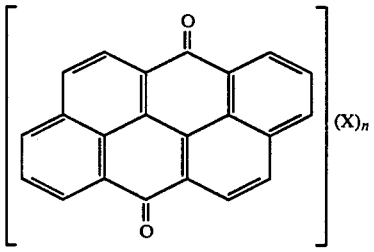

Formula (IV)

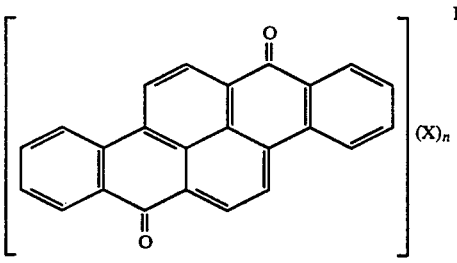

Formula (V)

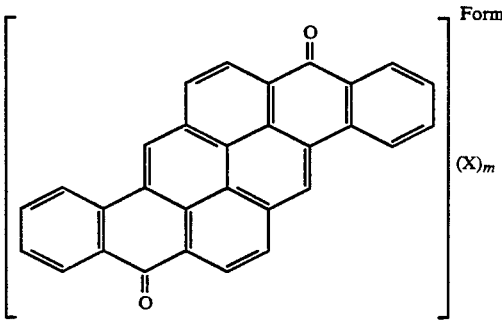

In the Formulas, X represents a halogen atom, or a nitro, cyano, acyl or carboxyl group, n represents an integer of 0 to 4, and m represents an integer of 0 to 6.

In the invention, it is preferable that the photoreceptive layer has at least a carrier generation layer and a carrier transfer layer or at least a layer containing a carrier generation material, a carrier transfer material and a binder.

The above object of the invention is achieved by an electrophotographic photoreceptor having at least a photoreceptive layer on a conductive support, wherein said photoreceptive layer is comprised of the perylene compound represented by the foregoing Formula (I) and/or Formula (II) and the perylene compound represented by the following Formula (VI).

Formula (VI)

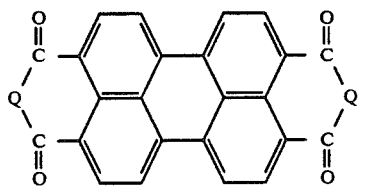

In the formula, Q represents

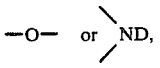

where D represents a hydrogen atom, or a substituted or unsubstituted alkyl, alkenyl, cycloalkyl, cycloalkenyl, aryl or heterocyclic group.

In the invention, it is preferable that the photoreceptive layer has at least a carrier generation layer and a carrier transfer layer, or at least a layer containing a carrier generation material, a carrier transfer material and a binder.

Figure 1A:
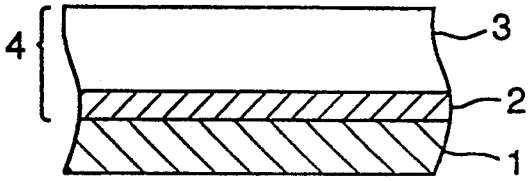
In FIG. 1, (*a*) to (*f*) are sectional views showing layer configurations of the photoreceptor of the invention.

1: a conductive support
2: a carrier generation layer
3: a carrier transfer layer
4: a photoreceptive layer
5: an intermediate layer

DETAILED DESCRIPTION OF THE INVENTION

The present invention is hereunder described in detail.

The electrophotographic photoreceptor of the invention contains, as a carrier generation material, at least the perylene compound represented by the foregoing Formula (I) or Formula (II).

In Formula (I) or (II), preferable examples of the aromatic ring represented by Z include a benzene, naphthalene, anthracene, phenanthrene, pyridine, pyrimidine, pyrazole and anthraquinone ring. Among these, benzene and naphthalene rings are preferred. Further, the aromatic ring represented by Z may have a substituent. Examples of the substituent include an alkyl, alkoxy, aryl, aryloxy, acyl, acyloxy, amino, carbomoyl, nitro and cyano group, and a halogen atom.

In the invention, it is preferable that the perylene compound represented by Formula (I) or Formula (II) is one having, in an X-ray diffraction spectrum with a Cu-Kα radiation, characteristic peaks at Bragg angles (2θ),6.3°±0.2°, 12.5°±0.2°, 25.4°±0.2° and 27.0°±0.2°.

Perylene compounds preferably used in the invention are exemplified below, but the embodiment of the invention is not limited to them.

| Exemplified Comp. No. | Z |
|---|---|
| A-1 | 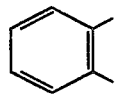 |
| A-2 | 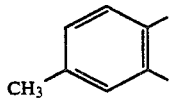 |
| A-3 | 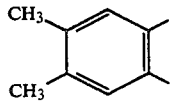 |
| A-4 | 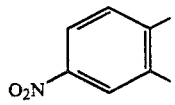 |
| A-5 | 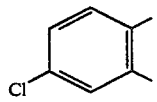 |
| A-6 | 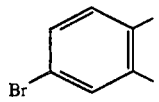 |
| A-7 | 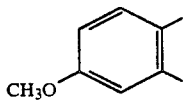 |
| A-8 | 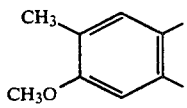 |
| A-9 | 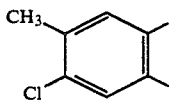 |
| A-10 | 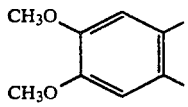 |
| A-11 | 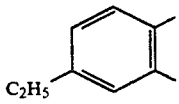 |
| A-12 | 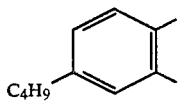 |

-continued

| Exemplified Comp. No. | Z |
|---|---|
| A-13 | 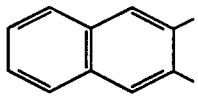 |
| A-14 | 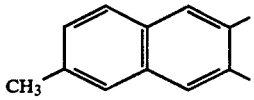 |
| A-15 | 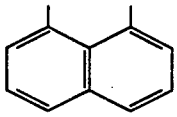 |
| A-16 | 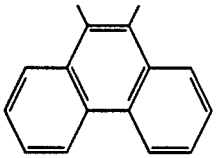 |
| A-17 | 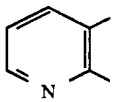 |
| A-18 | 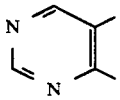 |
| A-19 | 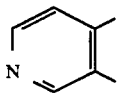 |
| A-20 | 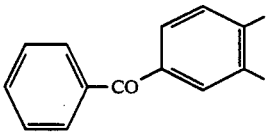 |
| A-21 | 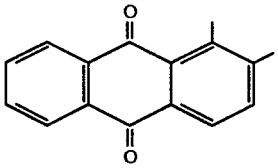 |

The electrophotographic photoreceptor of the invention contains at least the perylene compound represented by Formula (I) and/or Formula (II) and a polycyclic quinone compound or the perylene compound represented by Formula (VI).

The polycyclic quinone compound preferably used in the invention includes the anthanthrone pigment represented by the foregoing Formula (III), the dibenzopyrenequinone pigment represented by the foregoing Formula (IV) and the pyranethrone pigment represented by the foregoing Formula (V). Of these, the anthanthrone pigment represented by Formula (III) is particularly preferred. Typical examples of the anthanthrone pigment represented by Formula (III) include the compounds represented by one of the following Formulas (B-1) to (B-11).

Exemplified Compound (B-1)

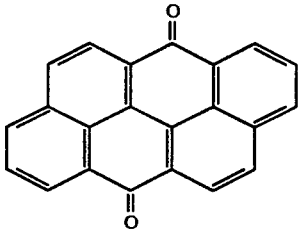

(B-2)

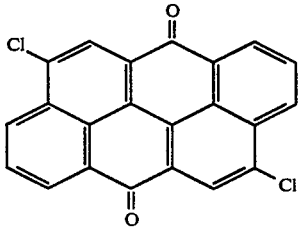

(B-3)

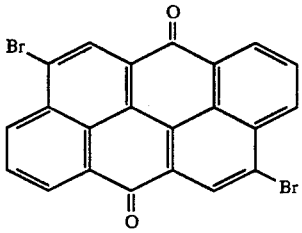

(B-4)

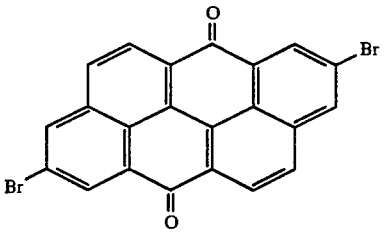

(B-5)

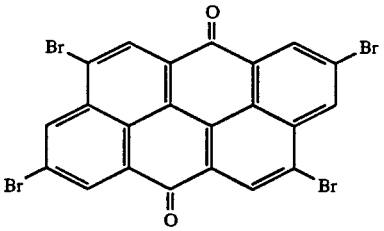

(B-6)

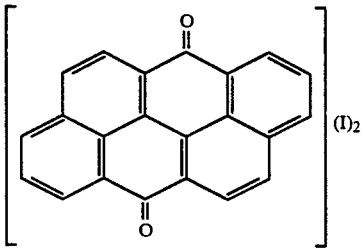

-continued (B-7)

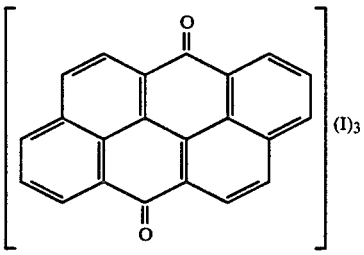

(B-8)

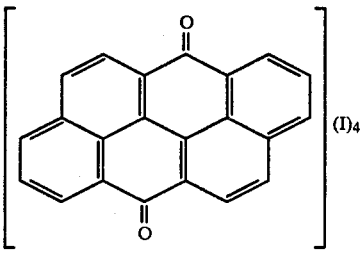

(B-9)

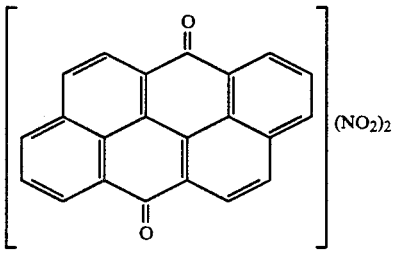

(B-10)

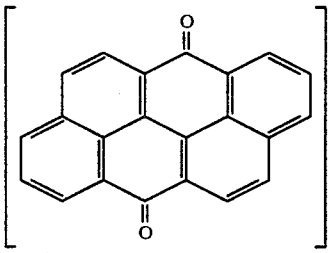

(B-11)

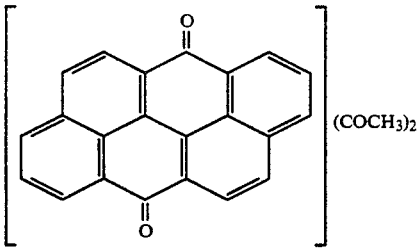

Typical examples of the dibenzopyrenequinone pigment and the pyranethrone pigment are described in detail on pages 12–13 of the specification of Japanese Pat. O.P.I. Pub. No. 277242/1989.

Next, the perylene compound represented by the foregoing Formula (VI) is described.

In Formula (VI), D represents a hydrogen atom, or an alkyl, alkenyl, cycloalkyl, cycloalkenyl, aryl or heterocyclic group, each of which may be a substituted or unsubstituted one. When D has a substituent, preferable examples thereof include a hydroxyl, alkoxy, amino and nitro group, and a halogen atom; provided that the substituted alkyl group includes an aralkyl group.

A preferable example of the perylene compound represented by Formula (VI) is shown below as exemplified compound C-1, but those usable in the invention are not limited to it. For example, the compounds described on page 12 of the specification of Japanese Pat. O.P.I. Pub. No. 28660/1990 can also be used in the invention.

Exemplified Compound C-1

N,N'-di-(4-methoxyphenyl)-perylene-3,4,9,10-tetracarboxylic acid diimide

Figure 1B:
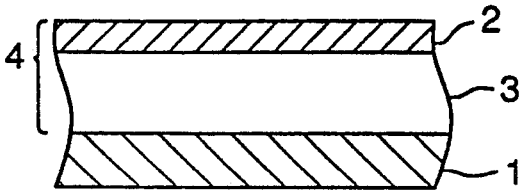
Figure 1C:
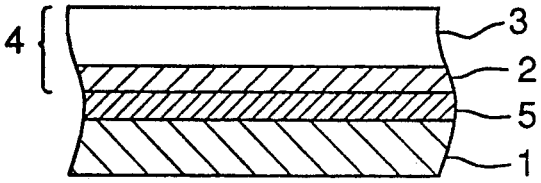
Figure 1D:
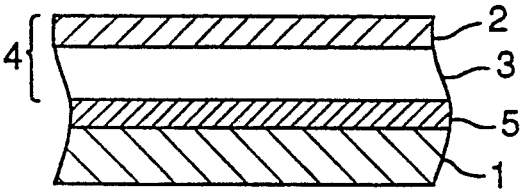
Figure 1E:
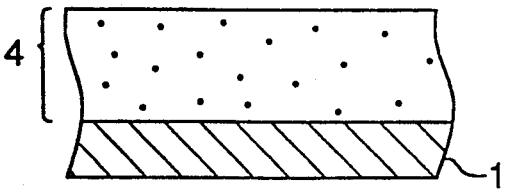
Figure 1F:
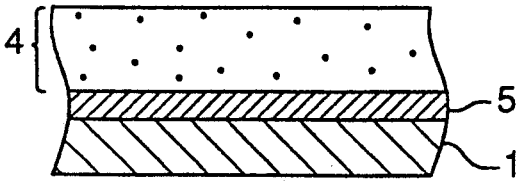

A variety of layer configurations are known as the structure of a photoreceptor. The photoreceptor of the invention may have any of such layer configurations, but it is preferred to be a function-separating photoreceptor of laminated type or dispersed type, which usually has one of the layer configurations illustrated by (a) to (f) of FIG. 1. In the layer configuration shown by (a), carrier generation layer 2 containing a carrier generation material is formed on conductive support 1, and carrier transfer layer 3 containing a carrier transfer material is provided thereon to form photoreceptive layer 4; (b) shows a layer configuration in which photoreceptive layer 4 is formed by providing carrier generation layer 2 and carrier transfer layer 3 in inverse order; in each of (c) and (d), intermediate layer 5, such as an adhesive layer or a barrier layer, is provided between photoreceptive layer 4 and conductive support 1 of the layer configuration of (a) or (b); the layer configuration of (e) has, on conductive support 1, photoreceptive layer 4 in which a carrier generation material, a carrier transfer material and a binder are dispersed; and in (f), intermediate layer 5 is provided between photoreceptive layer 4 and conductive support 1 of the layer configuration shown in (e). In these layer configuations of (a) to (f) of FIG. 1, a protective layer may be further provided as an outermost layer on the photoreceptive layer side, and carrier generation layer 2 may contain a carrier transfer material. In the invention, a particularly preferred photoreceptor is that which has at least two layers comprised of a carrier generation layer and a carrier transfer layer.

Carrier generation layer 2 can be formed by coating a coating solution prepared, for example, in the procedure described below directly on conductive support 1 or on carrier transfer layer 3, or by coating it on intermediate layer 5, such as an adhesive layer or a barrier layer, which may be provided when necessary.

(1) a solution prepared by dissolving the foregoing carrier generation materials all together or separately in a suitable solvent, or a solution obtained by dissolving further a carrier transfer material and a binder resin in the above solution according to a specific requirement, or (2) a dispersion prepared by pulverizing the foregoing carrier generation materials all together or separately to fine particles (the particle size is preferably not more than 5 μm, especially not more than 1 μm) in a dispersion medium using a ball mill or a sand grinder, adding thereto a binder resin and/or a carrier transfer material when necessary, and dispersing the mixture.

The solvent or dispersion medium used in the formation of the carrier generation layer includes n-butylamine, diethylamine, ethylenediamine, isopropanolamine, triethanolamine, triethylenediamine, N,N-dimethylformamide, acetone, methyl ethyl ketone, methyl isobutyl ketone, cyclohexanone, benzene, toluene, xylene, chloroform, 1,2-dichloroethane, 1,2-dichloropropane, 1,1,2-trichloroethane, 1,1,1-trichloroethane, trichloroethylene, tetrachloroethane, dichloroethane, tetrahydrofuran, dioxane, methanol, ethanol, isopropanol, ethyl acetate, butyl acetate, dimethylsulfoxide and methyl cellosolve. But solvents and dispersion media usable in the invention are not limited to them.

Also, the carrier transfer layer containing at least a carrier transfer material can be formed in a manner similar to that used with the carrier generation layer.

The binder resin used in forming the carrier generation layer or the carrier transfer layer may be arbitrarily selected, but preferred binder resins are those hydrophobic high-molecular polymers which have a high dielectric constant and a high film-forming property. Examples of such a high-molecular polymer include the following, but are not limited to them.

P-1) polycarbonates
P-2) polyesters
P-3) polymethacrylate
P-4) acrylic resins
P-5) polyvinyl chlorides
P-6) polyvinylidene chlorides
P-7) polystyrenes
P-8) polyvinyl acetates
P-9) styrene-butadiene copolymers
P-10) vinylchloride-acrylonitrile copolymers
P-11) vinylchloride-vinylacetate copolymers
P-12) vinylchloride-vinylacetate-maleic anhydride copolymers
P-13) silicone resins
P-14) silicone alkyd resins
P-15) phenol-formaldehyde resins
P-16) styrene-alkyd resins
P-17) poly-N-vinylcarbazoles
P-18) polyvinyl butyrals
P-19) polyvinyl formals These binder resins may be used singly or as a mixture of two or more kinds.

In the carrier generation layer formed as above, the weight ratio of the carrier generation material comprised of the perylene compound represented by Formula (I) and/or (II) and a polycyclic quinone compound or the perylene compound represented by Formula (vI) to the binder resin is preferably 100:0 to 1000. A content of the carrier generation material less than the above lowers the photosensitivity and causes the residual potential to increase; when the content is more than this, the dark attenuation and decay potential are lowered.

Further, the weight ratio of the perylene compound represented by Formula (I) and/or (II) to the polycyclic quinone compound or the perylene compound represented by Formula (IV) is preferably 0.01:100 to 100:100, especially 1:100 to 30:100.

When a carrier transfer material is contained in the carrier generation layer, the weight ratio of the carrier generation material to the carrier transfer material is preferably 10:0 to 10:1000, especially 10:0 to 10:100.

The thickness of the carrier generation layer so formed is preferably 0.01 to 10 μm.

In the carrier transfer layer formed as above, the amount of the carrier transfer material is preferably 20 to 200 parts by weight, especially 30 to 150 parts by weight per 100 parts by weight of binder resin contained in the carrier transfer layer.

The thickness of the carrier transfer layer is preferably 5 to 60 μm, especially 10 to 40 μm.

Carrier transfer materials usable in the invention are not particularly limited; examples thereof include oxazole derivatives, oxadiazole derivatives, thiazole derivatives, thiadiazole derivatives, triazole derivatives, imidazole derivatives, imidazolone derivatives, imidazolidine derivatives, bisimidazolidine derivatives, styryl compounds, hydrazone compounds, pyrazoline derivatives, amine derivatives, oxazolone derivatives, benzothiazole derivatives, benzimidazole derivatives, quinazoline derivatives, benzofuran derivatives, acridine derivatives, phenazine derivatives, aminostilbene derivatives, poly-N-vinylcarbazoles, poly-1-vinylpyrenes and poly-9-vinylanthracenes.

In selecting suitable carrier transfer materials, however, it is preferable to take into account not only their capabilities of transferring holes generated on light irradiation to the surface or the support of the photoreceptor but also their combinations with the carrier generation materials including the foregoing perylene compounds and polycyclic quinone compounds. Such suitable carrier transfer materials include the compounds represented by the following Formula (A), (B), (C) or (D).

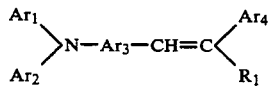

Formula (A)

wherein $Ar_1$, $Ar_2$ and $Ar_4$ each represent a substituted or unsubstituted aryl group; $Ar_3$ represents a substituted or unsubstituted arylene group; and $R_1$ represents a hydrogen atom, a substituted or unsubstituted alkyl group or a substituted or unsubstituted aryl group.

Typical examples of such compounds are described in detail on pages 3–4 of Japanese Pat. O.P.I. Pub. No. 65440/1983 and pages 3–6 of Japanese Pat. O.P.I. Pub. No. 198043/1983.

Formula (B)

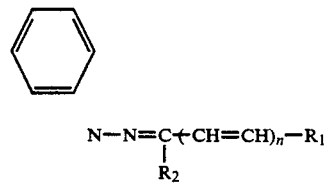

wherein $R_1$ represents a substituted or unsubstituted aryl group or a substituted or unsubstituted heterocyclic group $R_2$ represents a hydrogen atom, a substituted or unsubstituted alkyl group or a substituted or unsubstituted aryl group; and n represents an integer of 0 or 1. Such compounds are described in detail on pages 3–6 of Japanese Pat. O.P.I. Pub. No. 134642/1983 and pages 3–5 of Japanese Pat. O.P.I. Pub. No. 166354/1983.

Formula (C)

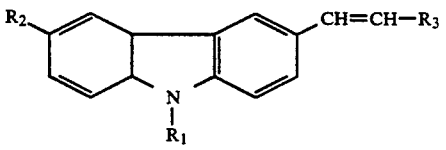

wherein $R_1$ represents a substituted or unsubstituted aryl group; $R_2$ represents a hydrogen atom, a halogen atom, a substituted or unsubstituted alkyl group, a substituted or unsubstituted alkoxy group, a substituted or unsubstituted amino group or a hydroxyl group; and $R_3$ represents a substituted or unsubstituted aryl group or a substituted or unsubstituted heterocyclic group. Synthesizing methods and exemplifications are shown on pages 3–5 of Japanese Pat. O.P.I. Pub. No. 148750/1982 and may be applicable to the embodiment of the invention.

Other carrier transfer materials suitable for the invention include the hydrazone compounds described in Japanese Pat. O.P.I. Pub. Nos. 67940/1982, 15252/1984 and 101844/1982.

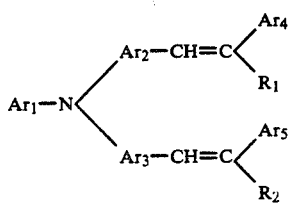

Formula (D)

Wherein $Ar_1$, $Ar_4$, $Ar_5$ each represent a substituted or unsubstituted aryl group, preferably a substituted or unsubstituted phenyl group or a substituted or unsubstituted naphthyl group; $R_1$ and $R_2$ each represent a hydrogen atom, a substituted or unsubstituted alkyl group or a substituted or unsubstituted aryl group, preferably a hydrogen atom, an alkyl group having 1 to 8 carbon atoms, a substituted or unsubstituted phenyl group or a substituted or unsubstituted naphthyl group; $Ar_2$ and $Ar_3$ each represent a substituted or unsubstituted arylene group, preferably a substituted or unsubstituted phenylene group or a substituted or unsubstituted naphthylene group.

Typical examples of the above compounds are shown on pages 4–10 of Japanese Pat. O.P.I. Pub. No. 32265/1989.

As the conductive support used in the electrophotographic photoreceptor of the invention includes metal or alloy plates, metal drums, or paper or plastic film made conductive by coating, depositing or laminating on them a conductive compound, such as a conductive polymer or indium oxide, or a thin layer of metal, such as aluminium, palladium or gold, or an alloy. The intermediate layer, such as an adhesive layer or a barrier layer, can be provided by use of the high-molecular polymer employed as the foregoing binder resin, an organic high-molecular compound such as polyvinyl alcohol, ethyl cellulose or carboxymethyl cellulose, or aluminium oxide.

The photoreceptive layer of the invention may contain an organic amine for improving the carrier generation function of the carrier generation material. Addition of a secondary amine is particularly preferred.

Examples of the secondary amine include dimethylamine, diethylamine, diethylamine, di-n-propylamine, di-isopropylamine, di-n-butylamine, di-isobutylamine, di-n-amylamine, di-isoamylamine, di-n-hexylamine, di-isohexylamine, di-n-pentylamine, di-isopentylamine, di-n-octylamine, di-isooctylamine, di-n-nonylamine, di-isononylamine, di-n-decylamine, di-isodecylamine, di-n-monodecylamine, di-isomonodecylamine, di-n-dodecylamine and di-isododecylamine.

Such organic amines are used in an amount not more than 1 mol, preferably 0.2 to 0.005 mol per mol of carrier generation material.

In the invention, the carrier generation layer may contain one or more kinds of electron accepting materials for the purposes of improving the sensitivity and minimizing the residual potential or fatigue in repeated use.

Usable electron accepting materials are, for example, succinic anhydride, maleic anhydride, dibromomaleic anhydride, phthalic anhydride, tetrachlorophthalic anhydride, tetrabromophthalic anhydride, 3-nitrophthalic anhydride, 4-nitrophthalic anhydride, pyromellitic anhydride, mellitic anhydride, tetracyanoethylene, tetracyanoquinodimethane, o-dinitrobenzene, m-dinitrobenzene, 1,3,5-trinitrobenzene, p-nitrobenzonitrile, picryl chloride, quinonechlorimide, chloranyl, bromanyl, dichlorodicyano-p-benzoquinone, anthraquinone, dinitroanthraquinone, 2,7-dinitrofluorenone, fluorenylidene[dicyanomethylene malonodinitrile], polynitro-9-fluorenylidene[dicyanomethylene malonodinitrile], picric acid, o-nitrobenzoic acid, p-nitrobenzoic acid, 3,5-dinitrobenzoic acid, pentafluorobenzoic acid, 5-nitrosalicylic acid, 3,5-dinitrosalicylic acid, phthalic acid, mellitic acid, and other compounds having a large electron affinity.

These electron accepting materials are used at a carrier-generation-material:electron-accepting-material weight ratio of 100:0.01 to 200, preferably 100:0.1 to 100.

The electron accepting material may be added in the carrier transfer layer. The addition amount of the electron accepting material to the layer is 100:0.01 to 100 and preferably 100:0.1 to 50 in carrier-generation-material:electron-accepting-material weight ratios.

The photoreceptor of the invention may contain a UV absorber to protect the photoreceptive layer and a dye to correct color sensitivity, when necessary.

EXAMPLES

The present invention is hereunder described in detail with examples, but the invention is not limited by them.

Example 1

Preparation of Coating Solution for Carrier Generation Layer

Solution A was prepared by dispersing 2 parts (parts by weight, the same applies hereinafter) of one of the perylene compounds (exemplified compound A-1) as carrier generation material (CGM 1) and 1 part of butyral resin Eslec B BX-1 (Sekisui Chemical Co.) as binder in 100 parts of 1,2-dichloroethane as solvent with a sand grinder for 20 hours.

Next, solution B was prepared by dispersing 5 parts of one of the polycyclic quinone compounds (exemplified compound B-3) as carrier generation material (CGM 2) and 2.5 parts of butyral resin Eslec B BX-1 in 100 parts of 1,2-dichloroethane with a sand grinder for 20 hours.

Solutions A and B were then mixed so as to give a CGM 1:CGM 2 weight ratio of 2:100; thus, a coating solution for carrier generation layer was obtained.

Preparation of Coating Solution for Carrier Transfer Layer

A coating solution for carrier transfer layer was prepared by dissolving 15 parts of the following CTM 1 as carrier transfer material and 20 parts of BPZ type polycarbonate Iupilon Z-200 (Mitsubishi Gas Chemical Co.) as binder in 100 parts of 1,2-dichloroethane.

Preparation of Photoreceptor

The coating solution for carrier generation layer was coated with a wire bar on an aluminium-deposited polyethyleneterephthalate base to form a carrier generation layer having a dry thickness of 1 μm. Then, the coating solution for carrier transfer layer was coated thereon with a blade coater and dried to form a carrier transfer layer having a dry thickness of 20 μm. Photoreceptor 1 was thus obtained.

CTM 1:

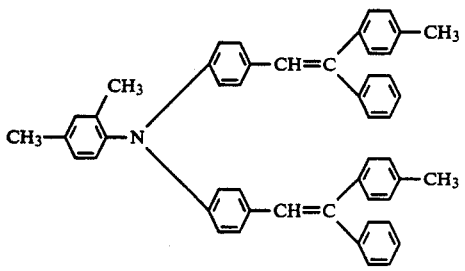

Next, the photoreceptor was subjected to the following characteristic tests:

Sensitivity Test

The exposure, El/2 (lux.sec), required to halve the initial surface potential of the photoreceptor was measured using an EPA-8100 electrostatic paper analyzer (Kawaguchi Electrical Machinery Co.)

Red Color Reproduction Test

Using a modified U-Bix 1550 electrophotographic copier (Konica Corp.) equipped with an electrometer for surface potential as a copier and a Kodak color control patch as an original, the surface potential of the photoreceptor corresponding to the red patch, $_{vred}$ (V), was measured while copying with an applied potential set to±600 V for the black paper in the patch and to±100 V for the white paper. The smaller the value of $_{vred}$ is, the poorer the red color reproduction becomes.

Repeatability Test

The process of electrification-exposure-discharge was repeated 1000 times using the above modified copier and the change in charged potential, ΔV (V), was measured at the first copying and at the 1000th copying.

The results are shown in Table 1.

Example 2

Photoreceptor 2 was prepared as in Example 1, except that the weight ratio of CGM 1 to CGM 2 in the coating solution for carrier generation layer was changed to 5:100. Using it, the same tests as in Example 1 were conducted. The results are shown in Table 1.

Comparative Example 1

Comparative photoreceptor 1 was prepared as in Example 1, except that the coating solution for carrier generation layer was made of solution A alone. The same tests as in Example 1 were conducted. The results are shown in Table 1.

Comparative Example 2

Comparative photoreceptor 2 was prepared as in Example 1, except that the coating solution for carrier generation layer was made of solution B alone. The same tests as in Example 1 were conducted. The results are shown in Table 1.

Example 3

Preparation of Coating Solution for Carrier Generation Layer

Solution C was prepared by dispersing 5 parts of one of the perylene compounds (exemplified compound A-2) as carrier generation material (CGM 1) and 5 parts of BPZ type polycarbonate Iupilon Z-200 as binder in 100 parts of 1,2-dichloroethanel as solvent with a sand grinder for 20 hours.

Separately, solution D was prepared by dispersing 3 parts of one of the polycyclic quinone compounds (exemplified compound B-3) as carrier generation material (CGM 2) and 3 parts of BPZ type polycarbonate Iupilon Z-200 as binder in 100 parts of 1,2-dichloroethane in a sand grinder for 30 hours. Solutions C and D were then mixed so as to give a CGM 1:CGM 2 weight ratio of 5:100. A coating solution for carrier generation layer was thus obtained.

Preparation of Coating Solution for Carrier Transfer Layer

A coating solution for carrier transfer layer was prepared by dissolving 15 parts of the following CTM 2 as carrier transfer material and 20 parts of BPZ type polycarbonate Iupilon Z-200 as binder in 100 parts of 1,2-dichloroethane.

Preparation of Photoreceptor

The coating solution for carrier transfer layer was coated with a blade coater on an aluminium-deposited polyethyleneterephthalate base and dried to form a carrier transfer layer having a dry thickness of 20 μm. Then, the coating solution for carrier generation layer was coated thereon with a blade coater and dried to form a carrier generation layer having a dry thickness of 1 μm. Thus, photoreceptor 3 was prepared.

Photoreceptor 3 was subjected to the characteristic tests in the same manner as in Example 1. The results are shown in Table 1.

CTM 2:

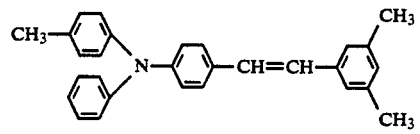

Example 4

Photoreceptor 4 was prepared as in Example 3,except that CGM 1 in the coating solution for carrier generation layer was replaced by exemplified compound A-13 and that the CGM 1 to CGM 2 weight ratio was changed to 15:100. The evaluation was made in the same procedure as in Example 3. The results obtained are shown in Table 1.

Example 5

Photoreceptor 5 was prepared as in Example 3, except that the following carrier transfer material (CTM 3) was added to the coating solution for carrier generation layer at a CTM 3 to (CGM 1+CGM 2) weight ratio of 150:100 and that the carrier generation layer was formed in a dry thickness of 5 μm. The evaluation was made in the same procedure as in Example 3. The results obtained are shown in Table 1.

CTM 3:

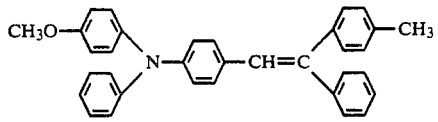

Example 6

Photoreceptor 6 was prepared as in Example 5, except that the carrier transfer layer was not provided and that carrier generation layer was formed in a dry thickness of 20 μm. Photoreceptor 6 so prepared was evaluated as in Example 5. The results are shown in Table 1.

Comparative Example 3

Comparative photoreceptor 3 was prepared as in Example 3, except that CGM 1 in the coating solution for carrier generation layer was replaced by the following compound (comparative CGM 1'). The same evaluation as in Example 3 was conducted. The results are shown in Table 1.

Comparative CGM 1':

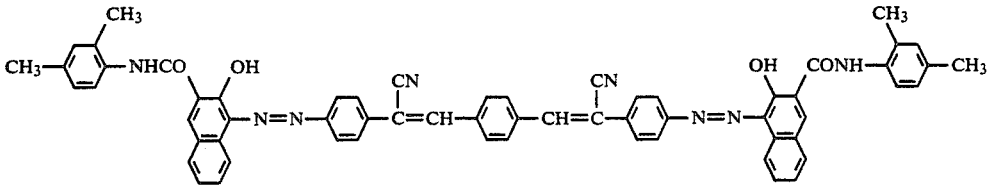

Comparative Example 4

Comparative photoreceptor 4 was prepared as in Example 3, except that τ-metal-free phthalocyanine (comparative CGM 1'') was used in the coating solution for carrier generation layer in place of CGM 1. The same evaluation as in Example 3 was conducted. The results are shown in Table 1.

As is apparent from Table 1, the photoreceptors of the invention, Examples 1 to 6 gave satisfactory results in all of the sensitivity, red color reproduction and repeatability, when compared with the photoreceptors of Comparative Examples 1 to 4.

TABLE 1

| | Carrier Generation Material | | CGM 1/CGM 2 weight | E1/2 | | | |
|---|---|---|---|---|---|---|---|
| | CGM 1 | CGM 2 | ratio | (lux sec) | Vred (V) | V (V) | Remarks |
| Ex. 1 | A-1 | B-3 | 2/100 | 2.4 | 440 | −5 (700→695) | |
| Ex. 2 | A-1 | B-3 | 5/100 | 2.1 | 400 | −10 (705→695) | |
| Comp. Ex. 1 | A-1 | — | 100/0 | 1.5 | 250 | −5 (705→700) | |
| Comp. Ex. 2 | — | B-3 | 0/100 | 3.3 | 590 | −5 (695→690) | |
| Ex. 3 | A-2 | B-3 | 5/100 | 2.2 | 405 | −10 (700→690) | |
| Ex. 4 | A-13 | B-3 | 15/100 | 2.1 | 400 | −5 (710→705) | |
| Ex. 5 | A-13 | B-3 | 15/100 | 2.2 | 410 | −15 (705→690) | containing CTM in CGL monolayered photoreceptive layer |
| Ex. 6 | A-13 | B-3 | 15/100 | 2.5 | 405 | −15 (700→685) | |
| Comp. Ex. 3 | CGM 1' | B-3 | 5/100 | 2.2 | 400 | −150 (700→550) | |
| Comp. Ex. 4 | CGM 1'' | B-3 | 5/100 | 2.1 | 380 | −125 (705→580) | |

Example 7

Photoreceptor 7 was prepared as in Example 1, except that CGM 2 in the coating solution for carrier generation layer was replaced by one of the perylene compounds (exemplified compound C-1), N,N'-di-(4-methoxyphenyl)-perylene-3,4,9,10-tetracarboxyacid diimide. The evaluation was conducted as in Example 1. The results are shown in Table 2.

Examples 8 to 12

Photoreceptors 8 to 12 were prepared as in Examples 2, 3, 4, 5 and 6, except that CGM 2 in the coating solution for carrier generation layer used in each example was replaced by one of the perylene compounds (exemplified compound C-1). The evaluation was conducted in the same manner as in Example 1.

Comparative Examples 5 to 8

Comparative photoreceptors 5 to 8 were prepared as in Comparative Examples 1, 2, 3 and 4, except that CGM 2 in the coating solution for carrier generation layer used in each comparative example was changed as shown in Table 2. The evaluation was conducted in the same manner as in Example 1. The results are shown in Table 2.

TABLE 2

| | Carrier Generation Material | | CGM 1/CGM 2 weight | E1/2 | | | |
|---|---|---|---|---|---|---|---|
| | CGM 1 | CGM 2 | ratio | (lux sec) | Vred (V) | V (V) | Remarks |
| Ex. 7 | A-1 | C-1 | 2/100 | 2.9 | 445 | −10 (705→695) | |
| Ex. 8 | A-1 | C-1 | 5/100 | 2.5 | 405 | −10 (700→690) | |
| Comp. Ex. 5 | A-1 | — | 100/0 | 1.5 | 250 | −5 (705→700) | |
| Comp. Ex. 6 | — | C-1 | 0/100 | 3.5 | 590 | −10 (695→685) | |
| Ex. 9 | A-2 | C-1 | 5/100 | 2.6 | 405 | −5 (700→695) | |
| Ex. 10 | A-13 | C-1 | 15/100 | 2.5 | 400 | −15 (705→690) | |
| Ex. 11 | A-13 | C-1 | 15/100 | 2.6 | 405 | −5 (710→705) | containing CTM in CGL monolayered photoreceptive layer |
| Ex. 12 | A-13 | C-1 | 15/100 | 2.9 | 410 | −10 (700→690) | |
| Comp. Ex. 7 | CGM 1' | C-1 | 5/100 | 2.6 | 400 | −160 (705→545) | |
| Comp. Ex. 8 | CGM 1" | C-1 | 5/100 | 2.4 | 385 | −150 (695→545) | |

As is apparent from Table 2, the photoreceptors of the invention in Examples 7 to 12 gave satisfactory values in all of the sensitivity, red color reproduction and repeatability, as compared with the photoreceptors in Comparative Examples 5 to 8.

What is claimed is:

1. An electrophotographic photoreceptor comprising a conductive support and provided thereon, a photoreceptive layer comprising a carrier generation layer containing 100 parts by weight of a polycyclic quinone compound and 0.01 to 100 parts by weight of at least one perulene compounds represented by the following Formulas (I) and (II):

Formula (I)

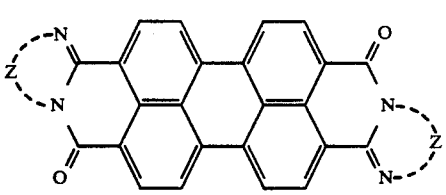

Formula (II)

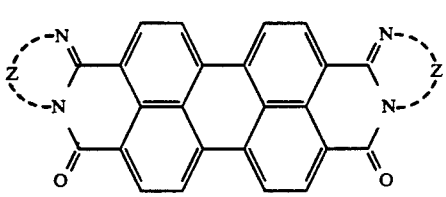

wherein Z represents a group of atoms necessary to form a substituted or unsubstituted aromatic ring.

2. The photoreceptor of claim 1, wherein said Z in Formula I and II includes a benzene ring, a naphthalene ring, an anthracene ring, a phenanthrene ring, a pyridine ring, a pyrimidine ring, a pyrazole ring, and an anthraquinone ring.

3. The photoreceptor of claim 1, wherein said Z in Formulas I and II includes a benzene ring and a naphthalene ring.

4. The photoreceptor of claim 1, wherein said polycyclic quinone compound is a compound represented by the following Formula (III), (IV) or (V):

Formula (III)

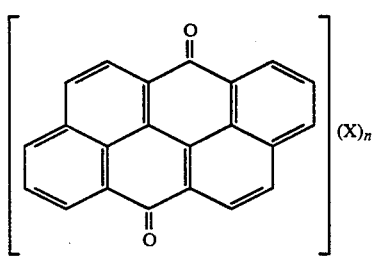

Formula (IV)

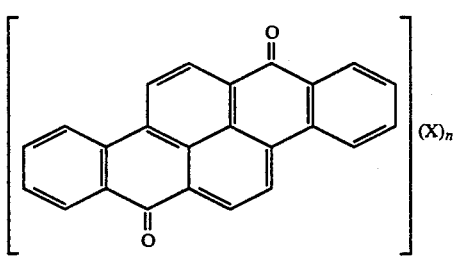

Formula (V)

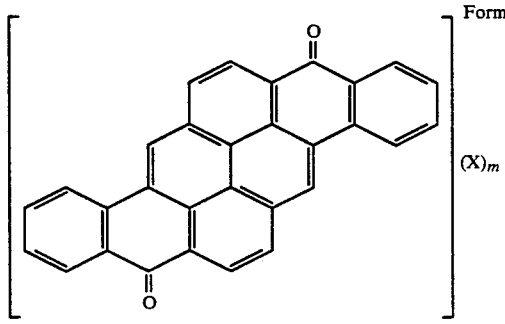

wherein X represents a halogen atom, a nitro group, a cyano group, an acyl group or a carboxyl group; n represents an integer of 0 to 4; and m represents an integer of 0 to 6.

5. The photoreceptor of claim 1, further comprising a carrier transfer layer containing a binder and a carrier transfer material.

6. The photoreceptor of claim 5, comprising a conductive support and provided thereon, the carrier generation layer and the carrier transfer layer in that order.

7. The photoreceptor of claim 5, comprising a conductive support and provided thereon, the carrier transfer layer and the carrier generation layer in that order.

8. The photoreceptor of claim 1, wherein said carrier generation layer further contains a carrier transfer material and a binder.

9. The photoreceptor of claim 1 wherein each of the Z groups in Formulas (I) and (II) represents:

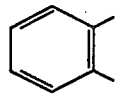

10. The photoreceptor layer of claim 1 wherein the carrier generation layer additionally contains an organic amine.

11. The photoreceptor layer of claim 1 wherein the carrier generation layer additionally contains one or more electron accepting materials.

* * * * *

UNITED STATES PATENT AND TRADEMARK OFFICE

CERTIFICATE OF CORRECTION

PATENT NO. : 5,320,921

DATED : June 14, 1994

INVENTOR(S) : Takeo OSHIBA et al.

It is certified that error appears in the above-indentified patent and that said Letters Patent is hereby corrected as shown below:

Claim 1, column 17, line 43: "perulene compounds" should read --perylene compounds--.

Signed and Sealed this

Thirteenth Day of December, 1994

*Attest:*

Bruce Lehman

BRUCE LEHMAN

*Attesting Officer*

*Commissioner of Patents and Trademarks*